United States Patent [19]

Solow

[11] Patent Number: 4,888,887

[45] Date of Patent: Dec. 26, 1989

[54] SUCTION-VENTILATED SHOE SYSTEM

[76] Inventor: Terry S. Solow, 410 Playa Blvd., La Selva Beach, Calif. 95076

[21] Appl. No.: 354,740

[22] Filed: May 22, 1989

Related U.S. Application Data

[63] Continuation-in-part of Ser. No. 269,019, Nov. 9, 1988, abandoned, which is a continuation-in-part of Ser. No. 74,255, Jul. 16, 1987, abandoned.

[51] Int. Cl.[4] ..... A43B 7/06; A43B 13/20; A43B 13/40

[52] U.S. Cl. ..... 36/3 R; 36/3 B; 36/29; 36/44; 128/588

[58] Field of Search ..... 36/3 B, 3 R, 44, 29; 128/588, 594

[56] References Cited

U.S. PATENT DOCUMENTS

| | | | |
|---|---|---|---|
| 2,358,342 | 9/1944 | Margolin | 128/588 |
| 4,078,321 | 3/1978 | Famolare, Jr. | 36/3 B |
| 4,654,982 | 4/1987 | Lee | 36/3 R |
| 4,674,200 | 6/1987 | Sing | 36/29 X |

FOREIGN PATENT DOCUMENTS

| | | | |
|---|---|---|---|
| 3228017 | 7/1983 | Fed. Rep. of Germany | 36/3 R |
| 230763 | 12/1985 | German Democratic Rep. | 36/3 R |
| 59-33363 | 8/1984 | Japan | 36/3 B |
| 1077613 | 3/1984 | U.S.S.R. | 36/3 B |
| 2165439 | 4/1986 | United Kingdom | 36/3 B |

*Primary Examiner*—James Kee Chi

[57] ABSTRACT

A suction-ventilated shoe system, which has air-exit ports located on the outer surface of said shoe, preferably in the midsole region, is provided. Said suction-ventilated shoe system contains a novel, multivented, suction-operated insole that enables the entire surface of said insole to be uniformly ventilated. Each air vent of said multivented, suction-operated insole contains its own independent, foot-operated, air-suction pump means, whose exhaust air is directed to exit the shoe via special air ducts that are connected between said insole's air-suction pump means and said shoe's air-exit ports. Each air-suction pump in said suction-operated insole has its own associated, one-way, air-valve means. A multiplicity of air vents may now be located anywhere over the entire surface of said insole and still maintain equal, air-suction, operating efficiency for each and every air vent. Said equal, air-suction, operating efficiency for each air vent is unaffected by which part of said insole is compressed first during each downstep, be it the heel part, the toe part or the entire insole at once. Also, said equal, air-suction, operating efficiency for each air vent is unaffected by whether or not said insole's air vents are only partially occluded by the sole of the foot during each downstep.

18 Claims, 6 Drawing Sheets

FIG. 1
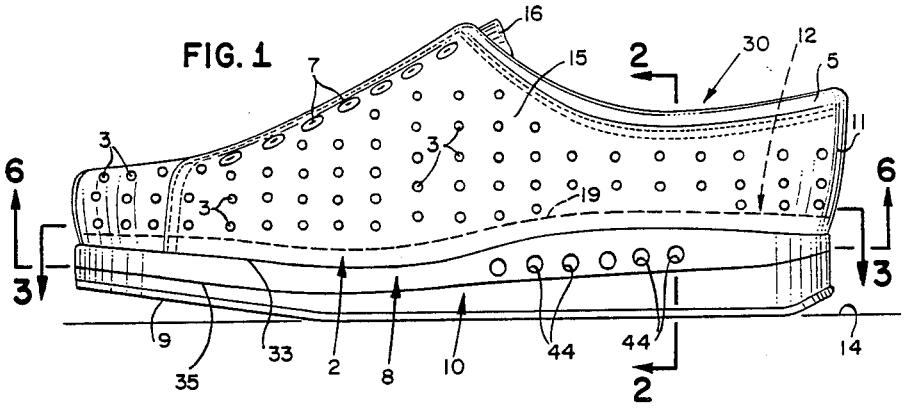
FIG. 2
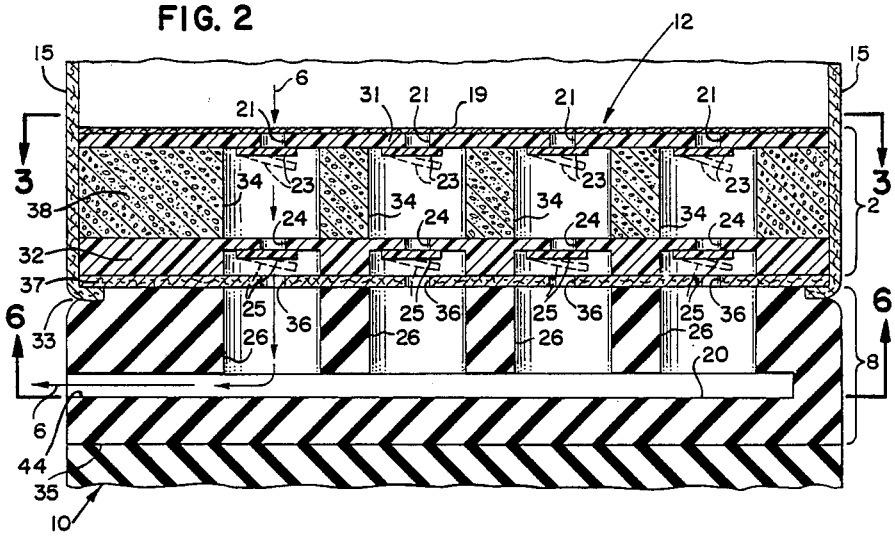
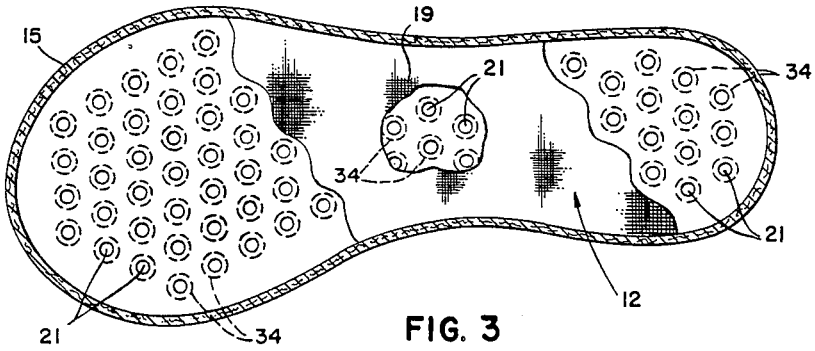
FIG. 3

FIG. 4
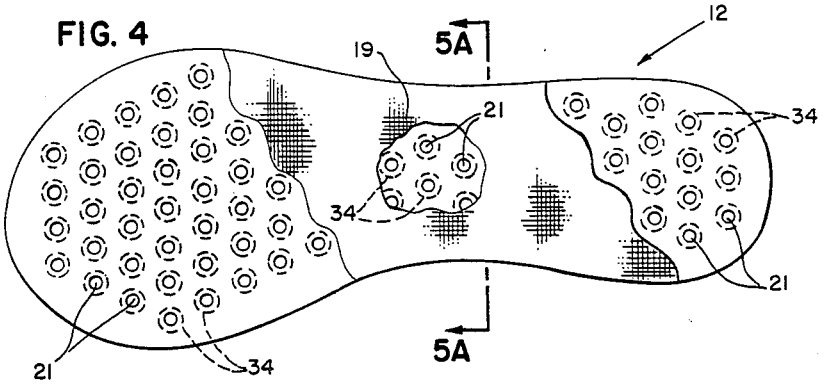
FIG. 5A
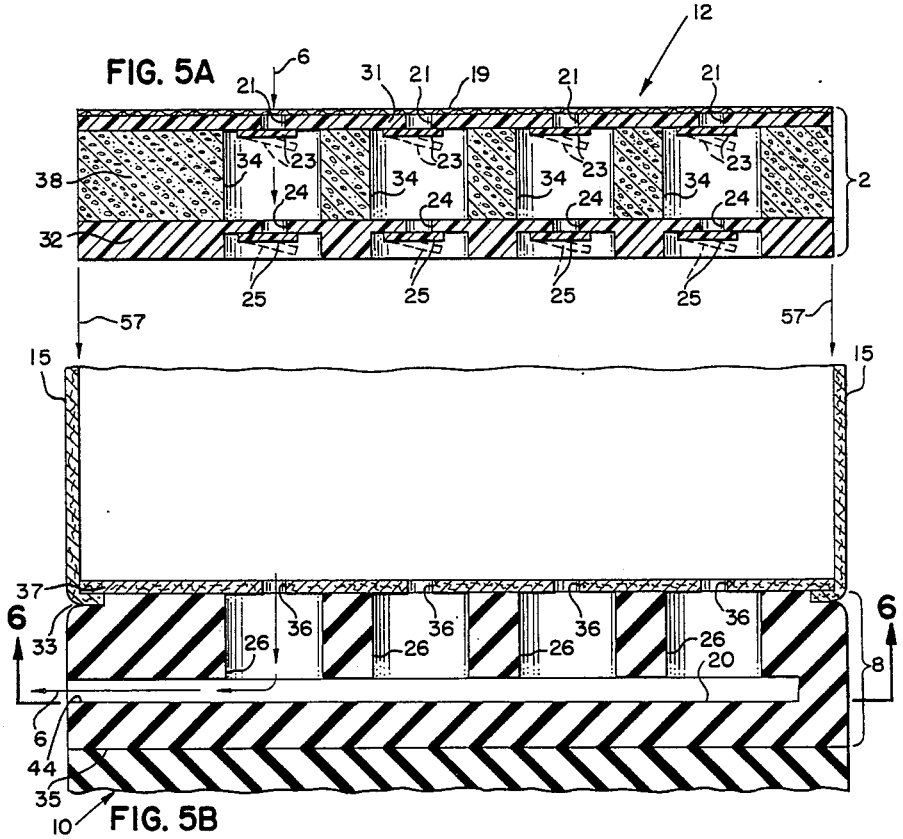
FIG. 5B

SUCTION-VENTILATED SHOE SYSTEM

REFERENCE TO RELATED APPLICATION

This application is a Continuation-In-Part of my application Ser. No. 07/269,019, filed Nov. 9, 1988, titled SUCTION-VENTILATED SHOE SYSTEM, now abandoned, which is a Continuation-In-Part of Ser. No. 07/074,255, filed July 16, 1987, titled SHOES WITH MULTIVENTED SUCTION INSOLES, now abandoned.

SUMMARY OF THE INVENTION

Because of the lack of air circulation in the area between the sole of a foot and the insole of a shoe, stagnant, sweaty, moist air tends to accumulate there. This is an especially serious problem in athletic shoes or work shoes where heavy exertion causes profuse sweating.

Some prior art attempted to solve the problem of ventilating an insole of a shoe by employing pressurized air from a single, large, bellows-type air pump located, generally, in the area of the heel of the insole. When one stepped down, the foot would compress said bellows and thus force compressed air, via long air ducts contained within said insole, to exit through small passive air-vent holes located, generally, in the area of the toes of said insole. Attempting to ventilate the entire insole by placing additional air-vent holes in the rest of said insole was a problem because the sole of the same foot that stepped down to compress said air bellows would also occlude said additional air-vent holes and thus inhibit the pressurized airflow.

Other prior art utilized a multivented, suction-operated insole containing valveless, air-vent holes located on the surface of said insole. However, said valveless, air-vent hole-type of insole has some serious problems. For example, all of said valveless, air-vent holes must be occluded by the sole of the foot during each downstep or the resulting air-pumping efficiency is very poor. This problem remains unsolved because the arched region of the toes of a foot leaves any air-vent holes in that important region uncovered. Thus, when the sole of the foot forces air out of the shoe by compressing the insole with each downstep, moist, stagnant air from the rest of the shoe mistakenly leaks out through said uncovered, air-vent holes in the region of the toes, instead of being forced outside of said shoe. This mistaken and misdirected air leakage is one important cause of said very poor air-pumping efficiency.

Additionally, during walking or jogging, since the sole of the foot touches the insole in a heel-to-toe-type of rolling motion for most people, the heel portion of said sole of the foot covers said insole's rearward, valveless, insole, air-vent holes first. This allows air to mistakenly leak out of the valveless, forward, air-vent holes of said insole, until the front of the sole of the foot finally comes down and occludes said valveless, forward, air-vent holes. Thus, this type of mistaken and misdirected air leakage, due to said rolling motion of the sole of the foot, additionally reduces the air-pumping efficiency even further. The present invention solves said prior art's problems with a unique, suction-ventilated shoe system that enables the entire surface of a suction-operated insole of a shoe to be ventilated with excellent air-pumping efficiency.

A suction-ventilated shoe system, which has air-exit ports located on the outer surface of said shoe, preferably in the midsole region, is provided. Said suction-ventilated shoe system contains a novel, multivented, suction-operated insole that enables the entire surface of said insole to be uniformly ventilated. Each air vent of said multivented, suction-operated insole contains its own independent, foot-operated, air-suction pump means, whose exhaust air is directed to exit the shoe via special air ducts that are connected between said insole's air-suction pump means and said shoe's air-exit ports. Each air-suction pump in said suction-operated insole has its own associated, one-way, air-valve means. A multiplicity of air vents may now be located anywhere over the entire surface of said insole and still maintain equal, air-suction, operating efficiency for each and every air vent. Said equal, air-suction, operating efficiency for each air vent is unaffected by which part of said insole is compressed first during each downstep, be it the heel part, the toe part or the entire insole at once. Also, said equal, air-suction, operating efficiency for each air vent is unaffected by whether or not said insole's air vents are only partially occluded by the sole of the foot during each downstep. Since said suction is only activated when the foot is lifted off the ground, at a time when the sole of the foot does not press against said insole, a small gap appears between the sole of the foot and said insole's air-vent holes; this gap allows suction to easily pull stagnant, sweaty air out through said insole's air-vent holes. Thus, the air-vent holes can now be placed over the entire surface of said insole without any sacrifice in air-pumping efficiency. Therefore, the present invention provides a suction-ventilated shoe system that is able to ventilate the entire insole of a shoe, keeping the foot dry and comfortable, even under conditions of very heavy exertion.

A first object of this invention is to ventilate every part of an entire insole of a shoe in a uniform manner. Prior art was able to ventilate only a part of an insole of a shoe.

A second object of this invention is to provide uniform ventilation of every part of an entire insole of a shoe wherein said uniform ventilation is independent of which part of said shoe's outsole makes contact with the ground first, be it the heel, the toe or the entire outsole at once. Among various joggers, all three of these latter conditions exist and are, therefore, important operating requirements.

A third object of this invention is to provide a shoe containing a multivented insole with a honeycomb-type of construction for maximum strength with regard to any strong lateral shoe forces.

A fourth object of this invention is to provide a shoe containing a multivented insole where each of said insole's air vents has its own built-in, foot-operated, air-suction pump means and wherein each air vent, regardless of location, is capable of sucking in an equal amount of air from the surface of said insole.

Various other features and advantages of this invention will be brought out in the balance of this specification.

BRIEF DESCRIPTION OF THE DRAWINGS

FIG. 1 is a perspective view of a shoe embodying this invention.

FIG. 2 is a sectional view taken on the line 2—2 of FIG. 1.

FIG. 3 is a sectional view taken on the line 3—3 of FIG. 1 and the line 3—3 of FIG. 2.

FIG. 4 is an elevational view of an another embodiment of this invention showing a self-contained, replaceable, multivented insole.

FIG. 5A is a sectional view taken on the line 5A—5A of FIG. 4.

FIG. 5B, taken in conjunction with FIG. 5A, is a partial, exploded view of FIG. 2.

DESCRIPTION OF THE PREFERRED EMBODIMENTS

Figure 6:
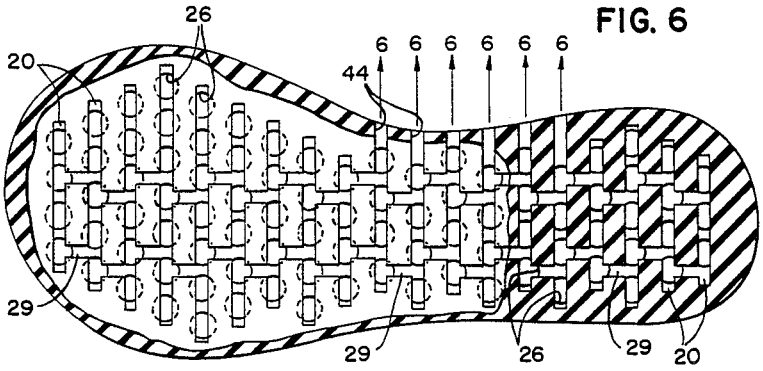
FIG. 6 is a sectional view and partial, x-ray view taken on the line 6—6 of FIG. 1 and the line 6—6 of FIG. 2.

A preferred embodiment of this invention is shown in FIGS. 1, 2, 3 and 6. The shoe 30 shown in FIG. 1 has a leather or plastic upper 15 with a plethora of ventilation holes 3 that allows fresh air to enter said shoe as a result of a mild vacuum created by a suction-operated insole 12. Shoelace holes 7 are conventional. Tongue 16 is made of open-weave nylon so as to allow air to ventilate through it freely. Outsole 9 is made of conventional, thin, treaded rubber that contacts the ground at 14. Lower midsole 10 is made of resilient, medium density, polyurethane foam for shock absorbency. Padded heel tab 5 and reinforced heel support 11 are conventional. Upper midsole 8 contains air ducts 20 and 29 and is made of high density, polyurethane foam that is resilient and flexible, but still will not compress too much so as not to constrict the free passage of exhaust air through air-vent holes 26 and said air ducts 20 and 29. Said upper midsole 8 is glued at 35 to said lower midsole 10. The junction 33 between the shoe upper 15 and the upper midsole 8 of shoe 30, on the outside surface of said shoe 30, is shown best in FIGS. 1 and 2. Multivented, suction-operated insole 12 has a thickness, delineated by bracket 2, as shown best in FIGS. 2 and 5A. Said insole 12 may either be permanently glued to flexible, full-length partition board 37 or may be manually placed into position against said partition board 37 so as to be removable from shoe 30 when desired.

To understand the operation of the multivented, suction-operated insole 12, please refer to FIGS. 1, 2, 3 and 6. Thin, open-weave, nylon filter cloth 19 is glued to a thin sheet of high density, air-tight polyurethane 31. Said sheet 31 contains an array of small air-vent holes 21 and is glued to one side of a slab of medium density, resilient, air-tight, polyurethane foam 38. Said slab of resilient foam 38 contains an array of larger air-vent holes 34. The other side of said slab of resilient foam 38 is glued to another sheet of high density, air-tight polyurethane 32. Said sheet 32 contains an array of air-vent holes 24 similar to the air-vent holes 21 of sheet 31. Sheet 32 is in turn glued to flexible, full-length partition board 37, which contains air-vent holes 36. Flap valves 23 are attached under all air-vent holes 21 and flap valves 25 are attached under all air-vent holes 24.

When one steps down, the sole of the foot contacts thin, filter cloth 19 and thus, resilient foam 38 is compressed. Said compression raises the air pressure in air-vent chambers 34 and said pressurized air is then forced to exit through flap valves 25. Said pressurized air then passes through air-vent holes 36 and 26 into air ducts 20 and 29 and thence exhausts out through air-exit port holes 44 to the outside of shoe 30. The path of said exhaust air 6 is shown in FIGS. 2 and 6.

When one lifts the foot off the ground, a small air gap appears between the sock-covered sole of the foot and thin, filter cloth 19. As resilient foam 38 starts to expand back to its original shape, flap valves 25 snap closed because a mild vacuum is created in air-vent chambers 34. Said mild vacuum sucks stagnant, moist air, located between said sock-covered sole of the foot and cloth 19, through said cloth 19 and through air-vent holes 21. This air flow opens flap valves 23 and thus said stagnant air enters air-vent chambers 34. A resupply of fresh air enters shoe 30 via the plethora of ventilation holes 3 in the shoe upper 15 because of the mild vacuum created by the action of suction-operated insole 12.

When one steps down again, the entire sequence is repeated. Thus, as one walks, runs, jumps or jogs, sweaty, moist air between the sock-covered sole of the foot and the air-filter cloth 19 is continually sucked through said cloth 19 via air-vent holes 21 and finally exhausts out through the upper midsole 8 via air-exit ports 44, as a sequence of puffs of air 6. FIGS. 2 and 6 show air-vent holes 26 that feed exhaust air to air ducts 20. Air ducts 20 are interconnected with other short air ducts 29, shown in FIG. 6, so that the exhaust air from the forward and rear regions of the insole 12 may easily find its way out of said shoe through said air-exit ports 44.

Therefore, we now have a multivented, suction-operated insole that keeps the entire sole of the foot dry rather than just a small part of it. The whole system is self-compensating in that the amount of suction always automatically adjusts to the need. Thus, when one runs very fast, the suction pumps operate at full speed and maximum pumping capacity. On the other hand, when one walks slowly, the suction pumps operate at low speed and minimum pumping capacity.

Another embodiment of this invention is shown in FIGS. 4, 5A and 5B, which is a partial, exploded view of FIGS. 2 and 3. In this embodiment, a removable, multivented, suction-operated insole 12, shown in FIGS. 4 and 5A, is similar to the glued-in, non-removable, multivented, suction-operated insole 12 of FIGS. 2 and 3. FIGS. 5A and 5B show insole 12 in a removed position, versus the in-place position shown in FIG. 2. Arrows 57 show the direction of movement of said insole 12, delineated by bracket 2, as it may be manually moved into its proper resting position against partition board 37, as shown in FIGS. 5A, 5B and 2. Once removable insole 12 is in place, its operation is the same as that previously described for the glued-in insole 12 of FIG. 2.

Figure 7:
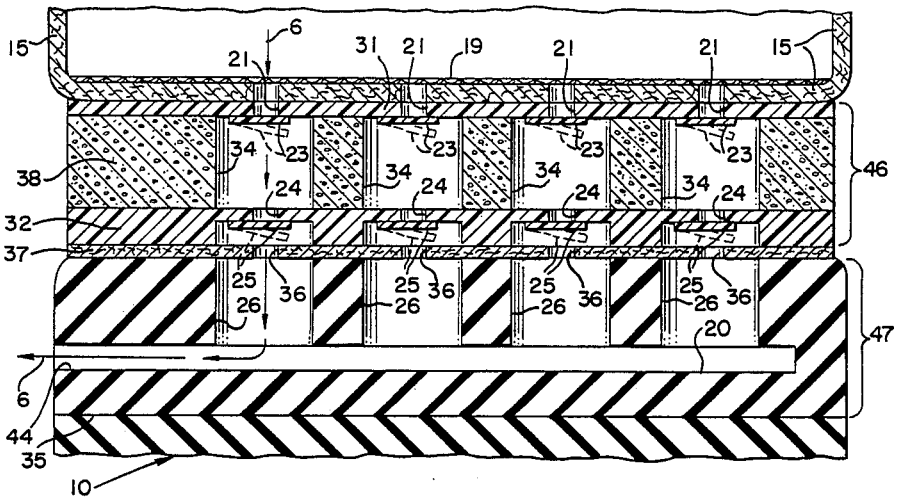
FIG. 7 is similar to FIG. 2, except that the suction-ventilated insole and its associated suction pumps, air ducts and air-exhaust means have all been mounted entirely below the shoe upper rather than partially within said shoe upper, as shown in FIG. 2.

Another embodiment of this invention is shown in FIG. 7, wherein the entire, suction-ventilated shoe system, consisting of suction-pump means 46, plus associated, air-exhaust duct means 47, has been mounted below the upper 15 of a shoe 30 rather than partially internal to said upper 15, as originally shown in FIG. 2. This approach may be employed where the elimination of extra play for the foot inside of the shoe 30 during walking or jogging is desired. This extra play for the foot is created in FIGS. 1, 2, 3 and 6 when resilient foam 38 is compressed as the foot steps down. However, in FIG. 7, where the entire, suction-ventilated system is mounted completely below said upper 15, this problem of extra play is eliminated, since the compression of foam 38 is now completely outside of said upper 15 of shoe 30.

Figure 8:
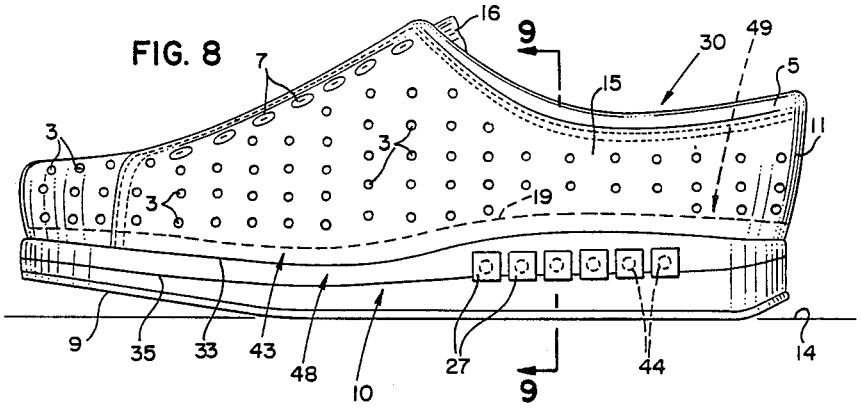
FIG. 8 is a perspective view of a shoe employing another embodiment of this invention utilizing external flap valves.
Figure 9:
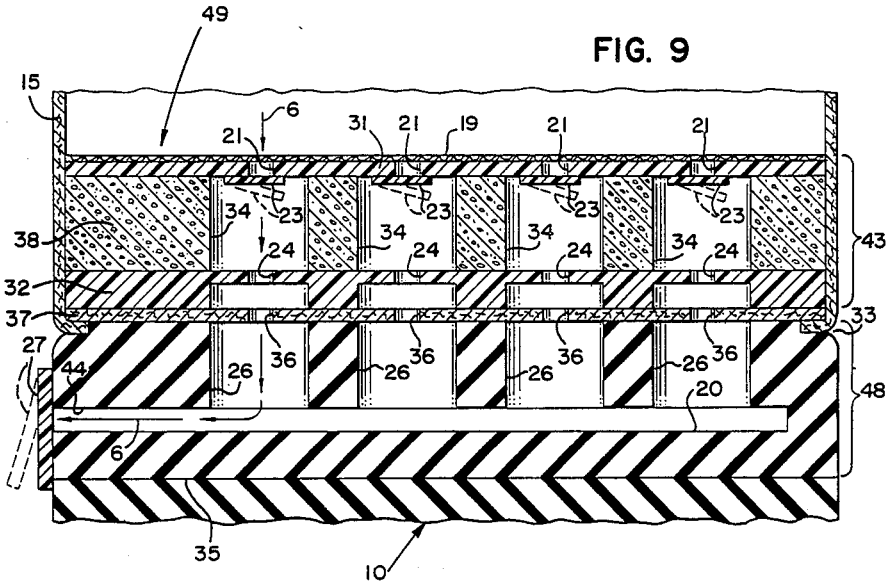
FIG. 9 is a sectional view taken on the line 9—9 of FIG. 8.

Another embodiment of this invention is shown in FIGS. 8, 9 and 6. This embodiment is similar in operation to the embodiment previously described and shown in FIGS. 1, 2, 3 and 6, except flap valves 25 have been deleted and external flap valves 27 have been substituted. Additionally, insole 49, delineated by bracket 43, has replaced insole 12, delineated by bracket 2. Thus, when one steps down, the sole of the foot contacts filter cloth 19 of insole 49 and compresses foam 38. Said compression raises the air pressure in air-vent chambers 34, air-vent holes 26 and air-exhaust ducts 20, delineated by bracket 48, forcing external flap valves 27 to open, thereby allowing exhaust air 6 to escape through air-exit port holes 44. Thus, in this embodiment, mud, dirt, water, etc. are kept from entering said air-exit port holes 44 by the addition of said external flap valves 27. However, the air-pumping efficiency of this embodiment is not quite as good as that of the embodiment shown in FIGS. 1, 2, 3 and 6.

Another embodiment of this invention (not shown) may be achieved by additionally employing the external flap valves 27 of FIGS. 8 and 9 added on to the embodiment of this invention shown in FIGS. 1 and 2. This would form a triple valve-type of a suction-ventilated shoe system that would be impervious to external mud, dirt, water, etc. and would still maintain the very high air-pumping efficiency of the original embodiment shown in FIGS. 1, 2, 3 and 6.

Figure 10:
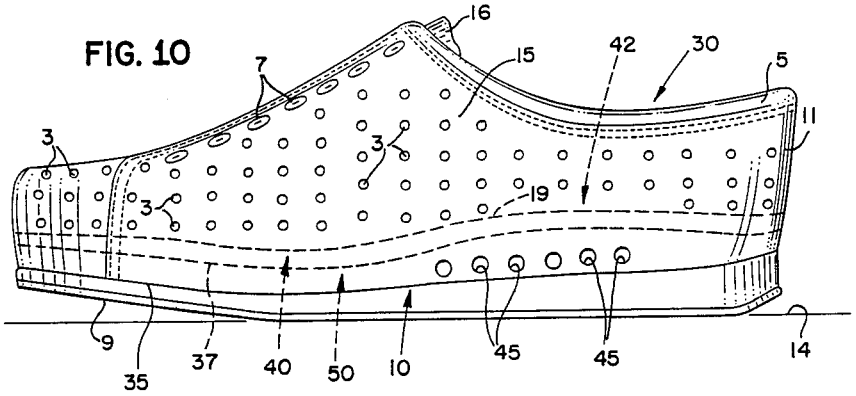
FIG. 10 is a perspective view of a hollow shoe with the insole removed. This embodiment of this invention employs a deeper upper than that shown in FIG. 1 so as to enable said shoe to carry the thicker, self-contained, suction-operated, replaceable insole of FIG. 11.
Figure 11:
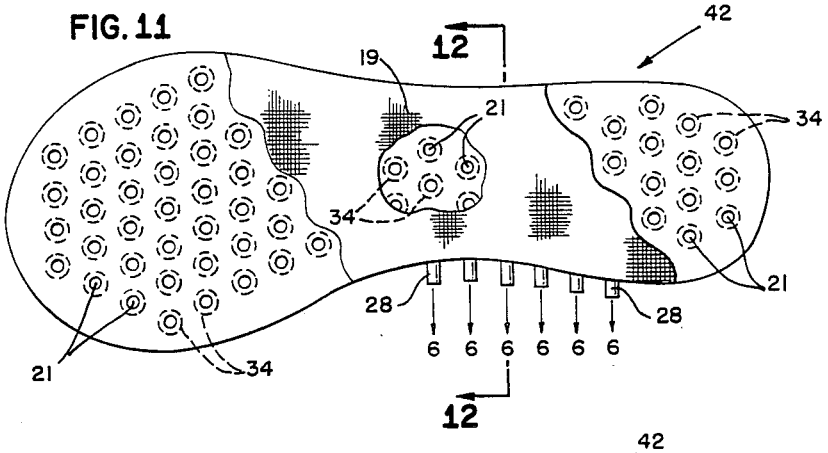
FIG. 11 is an elevational view of a self-contained, replaceable, suction-operated insole with ferrule means attached that is shown after said insole was removed from the shoe of FIG. 10.
Figure 12:
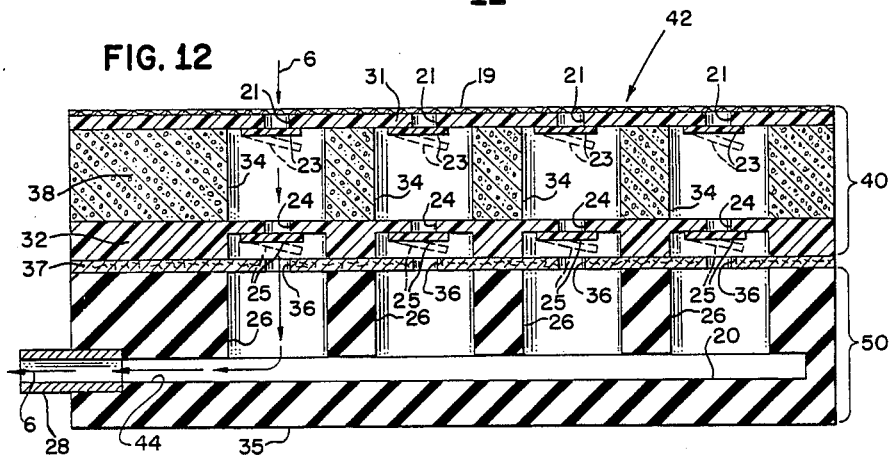
FIG. 12 is a sectional view taken on the line 12—12 of FIG. 11.

Another embodiment of this invention is shown in FIGS. 10, 11 and 12. In this embodiment, a new, removable insole 42 is shown. While the original, removable insole 12, which was previously described and shown in FIGS. 4, 5A and 5B, contained only suction-operated air pumps, delineated by bracket 2, insole 42 also contains the associated, air-exhaust ducts, delineated by bracket 40, in addition to suction-operated air pumps, delineated by bracket 50. This new configuration allows for a much simpler, low-cost shoe construction that does not need air ducts built directly into said shoe. Removable insole 42 is, therefore, a complete system in itself, which additionally, has hollow ferrules 28 protruding from its air-exit ports 44. When said removable insole 42 is inserted into shoe 30, said hollow ferrules 28 are manually pushed through special mating holes 45 in the lower part of upper 15, as shown best in FIGS. 10 and 11. This allows exhaust air 6 to exit the air-exit ports 44 via said special mating holes 45. Shoe 30 has an extra deep upper 15 and is hollow all the way down to the top 35 of midsole 10 so as to be able to accommodate the mating of said new, thicker, self-contained, removable insole 42. The operation of said new, removable insole 42, delineated by brackets 40 and 50, shown in FIGS. 11 and 12, is identical in operation to that previously described for glued-in insole 12, delineated by brackets 2 and 8, shown in FIGS. 2 and 3.

Figure 13:
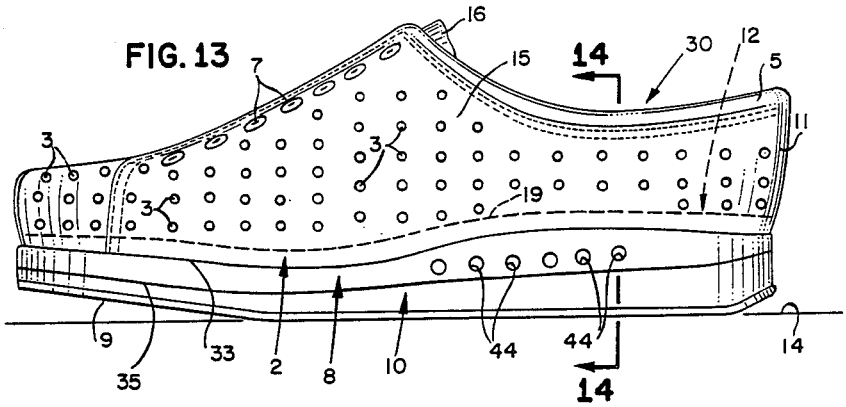
FIG. 13 is a perspective view of another embodiment of this invention employing foot-occluded, insole air-vent holes.
Figure 14:
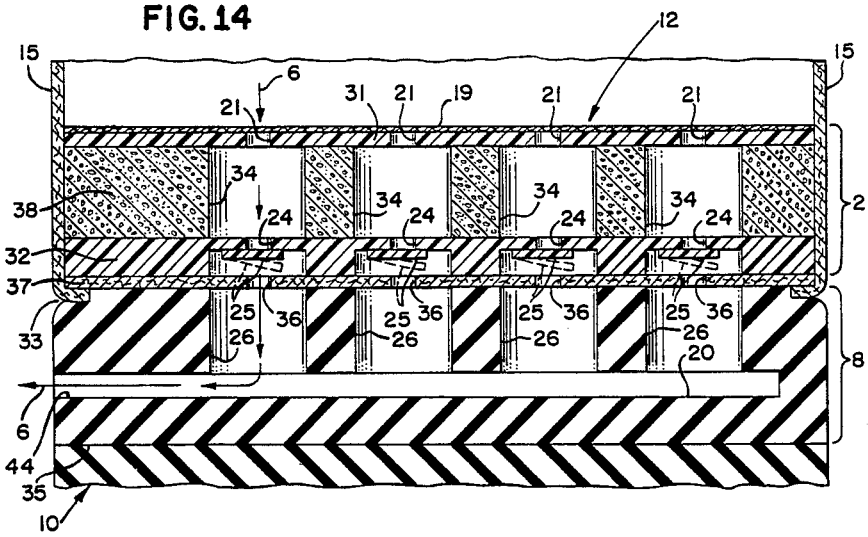
FIG. 14 is a sectional view taken on the line 14—14 of FIG. 13.

Another embodiment of this invention is shown in FIGS. 13 and 14. This embodiment is similar to the embodiment shown in FIGS. 1 and 2 except that flap-valves 23 of the multi-vented insole 12 have been deleted. The operation of the embodiment shown in FIGS. 13 and 14 is identical to that described for FIGS. 1 and 2, except the sole of the foot now substitutes for said deleted flap-valves 23 by occluding air vent holes 21 with each downstep. Thus, this embodiment has a lower manufacturing cost because of said deleted flap-valves 23. However, in this embodiment, the air pumping efficiency of the multi-vented insole 12 in the region of the arched toes is poor due to the mistaken air leakage around said arched toes, which do not properly occlude all of the air-vent holes 21 with each downstep. However, the air pumping efficiency of the rest of the multivented insole 12 is good.

An alternative embodiment (not shown) for said removable insole 42 may be achieved by gluing said insole 42 permanently into place inside of said shoe 30.

In regard to FIGS. 2, 5A, 7, 9 and 12, a small lip or shelf (not shown) may be added to each air-vent chamber wall 34 in order to limit any excess droop of each flap valve 23 due to the pull of gravity.

It is to be understood that the present invention is by no means limited to the particular construction herein disclosed and/or shown in the drawings, but also comprises any modifications or equivalents within the scope of the disclosure.

What is claimed is:

1. A suction-ventilated shoe system, comprising:

a shoe having at least one, air-exit port means located on its outer surface for exhausting air out of said shoe, and a suction-ventilated insole carried by said shoe, where said insole contains multiple, air-vent means plus foot-operated, multiple, suction-pump means, where said multiple, suction-pump means are connected to said multiple, air-vent means, wherein each one of said multiple, suction-pump means contains two, one-way, air-valve means, and air-duct means that are connected between said multiple, suction-pump means of said insole and said at least one, air-exit port means of said shoe.

2. The system of claim 1 wherein each one of said multiple, suction-pump means is located entirely inside of each one of said multiple, air-vent means.

3. The system of claim 1 wherein said suction-ventilated insole is replaceable.

4. The system of claim 1 wherein each of said at least one, air-exit port means is connected to its own additional, one-way, air-valve means.

5. The system of claim 1 wherein a porous material lies on top of said insole and covers said multiple, air-vent means so as to filter the air that is sucked into said air-vent means.

6. The system of claim 1 wherein said at least one, air-exit port means is located in the midsole region of said shoe.

7. The system of claim 1 wherein said multiple, suction-pump means and said air-duct means are located below said shoe's upper.

8. A suction-ventilated shoe system, comprising:

a shoe having at least one, air-exit port means located on its outer surface for exhausting air out of said shoe, and a suction-ventilated insole carried by said shoe, where said insole contains multiple, air-vent means plus foot-operated, multiple, suction-pump means, where said multiple, suction-pump means are connected to said multiple, air-vent means, wherein each one of said multiple, suction-pump means contains one, one-way, air-valve means, and air-duct means that are connected between said multiple, suction-pump means of said insole and said at least one, air-exit port means of said shoe, wherein each of said at least one, air-exit port means is connected to its own additional, one-way, air-valve means.

9. The system of claim 8 wherein said suction-ventilated insole is replaceable.

10. The system of claim 8 wherein said at least one, air-exit port means is located in the midsole region of said shoe.

11. The system of claim 8 wherein said multiple, suction-pump means and said air-duct means are located below said shoe's upper.

12. A suction-ventilated shoe system comprising:

a shoe having at least one, air-exit port means located on its outer surface for exhausting air out of said shoe, and a suction-ventilated insole carried by said shoe, where said insole contains multiple, air-vent means plus foot-operated, multiple, suction-pump means plus air-duct means that are all interconnected in order to exhaust air out of said air-duct means, wherein each one of said multiple, suction-pump means contains two, one-way, air-valve means, and means for mating said air-duct means to said at least one, air-exit port means of said shoe.

13. The system of claim 12 wherein said means for mating said air-duct means to said at least one, air-exit port means of said shoe are hollow ferrule means.

14. The system of claim 12 wherein said suction-ventilated insole is replaceable.

15. The system of claim 12 wherein said at least one, air-exit port means is located in the lower portion of the upper of said shoe.

16. A suction-ventilated shoe system, comprising:

a shoe having at least one, air-exit port means located on its outer surface for exhausting air out of said shoe, and a suction-ventilated insole carried by said shoe, where said insole contains multiple, air-vent means plus foot-operated, multiple, suction-pump means, where said multiple, suction-pump means are connected to said multiple, air-vent means, wherein each one of said multiple, suction-pump means contains one, one-way, air-valve wherein the sole of the foot acts as a second, one-way air-valve means by occluding said multiple, air-vent means with each downstep, and air-duct means that are connected between said multiple, suction-pump means of said insole and said at least one, air-exit port means of said shoe.

17. The system of claim 16 wherein said suction-ventilated insole is replaceable.

18. The system of claim 16 wherein said at least one, air-exit port means is located in the midsole region of said shoe.

* * * * *